US009493277B2

(12) United States Patent
Parikh et al.

(10) Patent No.: US 9,493,277 B2
(45) Date of Patent: Nov. 15, 2016

(54) TAMPER EVIDENT CONTAINER WITH FRANGIBLE HINGE

(71) Applicant: POLARPAK INC., Toronto (CA)

(72) Inventors: Samir R. Parikh, Brampton (CA); Sajith Chenat, Brampton (CA)

(73) Assignee: POLARPAK INC., Toronto (CA)

( * ) Notice: Subject to any disclaimer, the term of this patent is extended or adjusted under 35 U.S.C. 154(b) by 0 days.

(21) Appl. No.: 14/093,006

(22) Filed: Nov. 28, 2013

(65) Prior Publication Data

US 2015/0175315 A1 Jun. 25, 2015

Related U.S. Application Data

(63) Continuation of application No. 12/606,770, filed on Oct. 27, 2009.

(60) Provisional application No. 61/108,968, filed on Oct. 28, 2008.

(51) Int. Cl.
*B65D 43/02* (2006.01)
*B65D 43/16* (2006.01)
(Continued)

(52) U.S. Cl.
CPC ..... *B65D 41/32* (2013.01); *B65D 43/0254* (2013.01); *B65D 43/164* (2013.01); *B65D 2543/0062* (2013.01); *B65D 2543/00101* (2013.01); *B65D 2543/00222* (2013.01); *B65D 2543/00296* (2013.01); *B65D 2543/00351* (2013.01); *B65D 2543/00509* (2013.01); *B65D 2543/00685* (2013.01);
(Continued)

(58) Field of Classification Search
CPC ..... B65D 43/162; B65D 43/0235; B65D 2101/0023; B65D 2101/0053; B65D 2101/0092
USPC ..... 220/26
See application file for complete search history.

(56) References Cited

U.S. PATENT DOCUMENTS 1,726,103 A 8/1929 Gibson
2,765,097 A 7/1954 Dobson et al.
(Continued)

FOREIGN PATENT DOCUMENTS

CA 2074836 6/1992
CA 2565256 6/2007
(Continued)

OTHER PUBLICATIONS

Letter from McGarry Bair PC, Apr. 19, 2016, addressed to James Raakman of Bereskin & Parr LLP, pp. 1-2. 2016.

*Primary Examiner* — Fenn Mathew
*Assistant Examiner* — Andrew T Kirsch
(74) *Attorney, Agent, or Firm* — Bereskin & Parr LLP/S.E.N.C.R.L., s.rl.

(57) ABSTRACT

A container includes a base having a base peripheral portion and a lid having a lid peripheral portion. The lid peripheral portion is mountable to the base peripheral portion to mount the lid to the base for closing the container. A frangible hinge member pivotably joins the base to the lid. The hinge member includes a base hinge panel joined to the base peripheral portion, and a lid hinge panel joined to the lid peripheral portion. The base and lid hinge panels are pivotally joined together at a pivot region. One of the base hinge panel and the lid hinge panel is separable along a line of weakness into a grasping portion connected to one of the base and the lid, and a flap portion connected to the pivot region.

39 Claims, 9 Drawing Sheets

(51) Int. Cl.
*B65D 17/50* (2006.01)
*B65D 41/02* (2006.01)
*B65D 41/32* (2006.01)

(52) U.S. Cl.
CPC ..... *B65D 2543/00731* (2013.01); *B65D 2543/00796* (2013.01); *B65D 2543/00842* (2013.01)

(56) References Cited

U.S. PATENT DOCUMENTS

| | | | |
|---|---|---|---|
| 2,798,631 | A | 7/1957 | Engel |
| 2,915,214 | A | 12/1959 | Morris |
| 3,043,354 | A | 7/1962 | Fitzgerald |
| 3,080,087 | A | 3/1963 | Cloyd |
| 3,097,758 | A | 7/1963 | Gershen et al. |
| 3,142,409 | A | 7/1964 | Ross |
| 3,164,478 | A | 1/1965 | Bostrom |
| 3,421,654 | A | 1/1969 | Hexel |
| 3,511,433 | A | 5/1970 | Andrews et al. |
| 3,536,251 | A | 10/1970 | Edwards |
| 3,670,922 | A | 6/1972 | Phillips |
| 3,767,110 | A | 10/1973 | Congleton |
| 3,786,982 | A | 1/1974 | Rakes et al. |
| 4,030,630 | A | 6/1977 | Yealy |
| 4,043,482 | A | 8/1977 | Brown |
| 4,111,329 | A | 9/1978 | Lampman |
| 4,113,136 | A | 9/1978 | Abbott |
| 4,124,141 | A | 11/1978 | Armentrout et al. |
| 4,180,179 | A | 12/1979 | Hoenig et al. |
| 4,332,332 | A | 6/1982 | Ingemann |
| 4,433,793 | A | 2/1984 | Ingemann |
| 4,452,382 | A | 6/1984 | Von Holdt |
| 4,474,305 | A | 10/1984 | Marco |
| 4,488,658 | A | 12/1984 | Smith et al. |
| 4,520,943 | A | 6/1985 | Nielsen |
| 4,535,889 | A | 8/1985 | Terauds |
| 4,576,370 | A | 3/1986 | Jackson |
| 4,602,718 | A | 7/1986 | Dutt |
| 4,643,329 | A | 2/1987 | Mobberley et al. |
| 4,711,364 | A | 12/1987 | Letica |
| 4,732,293 | A | 3/1988 | Landis |
| 4,742,935 | A | 5/1988 | Schellenberg |
| 4,759,463 | A | 7/1988 | Mazoin |
| 4,782,977 | A | 11/1988 | Watanabe et al. |
| 4,792,054 | A | 12/1988 | Weidman |
| 4,919,286 | A | 4/1990 | Agbay, Sr. |
| 4,940,158 | A | 7/1990 | Farrell et al. |
| 4,942,974 | A | 7/1990 | Larrison |
| 4,986,438 | A | 1/1991 | Borst |
| 4,997,100 | A | 3/1991 | Dudek |
| 5,027,969 | A | 7/1991 | Lesquir |
| 5,040,695 | A | 8/1991 | Adams et al. |
| 5,046,659 | A | 9/1991 | Warburton et al. |
| 5,052,574 | A | 10/1991 | McKinnon et al. |
| 5,085,339 | A | 2/1992 | Roth et al. |
| 5,092,479 | A | 3/1992 | Wells |
| 5,114,068 | A | 5/1992 | Reil |
| 5,129,517 | A | 7/1992 | Hustad |
| 5,161,711 | A | 11/1992 | Picozza et al. |
| 5,163,575 | A | 11/1992 | Luch et al. |
| 5,170,905 | A | 12/1992 | Luch |
| 5,219,087 | A | 6/1993 | Christensson |
| 5,249,694 | A | 10/1993 | Nelson |
| 5,287,959 | A | 2/1994 | Hansen et al. |
| 5,303,839 | A | 4/1994 | Blumenschein |
| 5,307,949 | A | 5/1994 | Von Holdt, Jr. |
| 5,311,990 | A | 5/1994 | Kalinski |
| D352,000 | S | 11/1994 | Hansen et al. |
| 5,398,836 | A | 3/1995 | Luch et al. |
| 5,429,833 | A | 7/1995 | Wyslotsky |
| 5,507,406 | A | 4/1996 | Urciuoli et al. |
| 5,573,134 | A | 11/1996 | Chenault et al. |
| 5,584,408 | A | 12/1996 | Orkisz |
| 5,758,791 | A | 6/1998 | Mangla |
| 5,788,105 | A | 8/1998 | Foos |
| 5,842,592 | A | 12/1998 | Beck |
| 5,860,530 | A | 1/1999 | Simmons et al. |
| 5,897,011 | A † | 4/1999 | Brilliant |
| 5,931,291 | A | 8/1999 | Sedon et al. |
| 5,931,332 | A | 8/1999 | Mygatt et al. |
| 5,938,068 | A | 8/1999 | Atkins et al. |
| 5,979,687 | A | 11/1999 | Hayes et al. |
| 6,145,688 | A | 11/2000 | Smith |
| 6,196,408 | B1 | 3/2001 | Setty et al. |
| 6,257,435 | B1 | 7/2001 | Chedister et al. |
| 6,360,909 | B1 | 3/2002 | Bridge |
| 6,364,114 | B1 | 4/2002 | Glassman |
| 6,572,909 | B1 | 6/2003 | Bagwell et al. |
| 6,609,623 | B2 | 8/2003 | Chou |
| 6,715,632 | B2 | 4/2004 | Baker |
| 7,073,680 | B2 | 7/2006 | Boback et al. |
| 7,118,003 | B2 † | 10/2006 | Sellari |
| 7,159,733 | B2 | 1/2007 | Pickles |
| 7,246,714 | B2 * | 7/2007 | Garg et al. ..... 220/4.23 |
| 7,568,589 | B2 | 8/2009 | Vovan |
| 7,631,776 | B2 | 12/2009 | Vovan et al. |
| 2002/0134783 | A1 | 9/2002 | Arshinoff |
| 2003/0034323 | A1 | 2/2003 | Smith et al. |
| 2003/0052133 | A1 | 3/2003 | Hayes et al. |
| 2003/0057209 | A1 | 3/2003 | Seelhofer |
| 2004/0118848 | A1 | 6/2004 | Marshall |
| 2005/0161455 | A1 | 7/2005 | Studee |
| 2006/0289541 | A1 | 12/2006 | Boback et al. |
| 2007/0045317 | A1 | 3/2007 | Rosender et al. |
| 2007/0138046 | A1 | 6/2007 | Vovan |
| 2007/0138180 | A1 | 6/2007 | Vovan |
| 2008/0087669 | A2 | 4/2008 | Boback et al. |

FOREIGN PATENT DOCUMENTS

| | | |
|---|---|---|
| DE | 4418935 | 12/1995 |
| DE | 1999083197 | 8/1999 |
| EP | 0658486 | 6/1995 |
| EP | 0752374 | 8/1997 |
| EP | 1725469 | 5/2011 |
| FR | 2691952 | 12/1993 |
| FR | 2727387 | 5/1996 |
| FR | 2811638 | 1/2002 |
| FR | 2819496 | 7/2002 |
| GB | 2219284 | 12/1989 |
| GB | 2227481 | 8/1990 |
| GB | 2257118 | 1/1993 |
| GB | 2346868 | 8/2000 |
| GB | 2412651 | 10/2005 |
| JP | 6197183 | 6/1986 |
| JP | 7267275 | 10/1995 |
| NL | 2001106 | 12/2007 |
| WO | 9513222 | 5/1995 |
| WO | 03022703 | 3/2003 |
| WO | 2005009857 | 2/2005 |
| WO | 2005082733 | 9/2005 |

* cited by examiner
† cited by third party

TAMPER EVIDENT CONTAINER WITH FRANGIBLE HINGE

This application is a continuation of U.S. patent application Ser. No. 12/606,770, filed Oct. 27, 2009, which claims the benefit of U.S. Provisional Patent Application No. 61/108,968, filed Oct. 28, 2008, which is hereby incorporated herein by reference.

FIELD

The specification relates to containers. More specifically, the specification relates to containers that are configured to provide a visual indication that the container has been previously opened.

INTRODUCTION

The following is not an admission that anything discussed below is prior art or part of the common general knowledge of persons skilled in the art.

Containers are used to store many types of items, such as foodstuffs, medicine, or numerous other types of materials.

U.S. Pat. No. 7,073,680 (Boback et al.) discloses a tamper-resistant container with tamper-evident features which includes a cover portion defining a outwardly extending peripheral flange, a base portion defining an upper peripheral edge, a hinge joining the outwardly extending peripheral flange with the base portion and an engagement mechanism for maintaining the peripheral flange adjacent to the upper peripheral edge when the container is closed. The upper peripheral edge includes an upwardly projecting bead extending substantially about the perimeter of the base portion that is configured to render the outwardly extending flange of the cover portion relatively inaccessible when the container is closed. The hinge includes a frangible section, which upon severing, provides a projection that extends out beyond the upwardly projecting bead of the upper peripheral edge of the base portion, for facilitating the disengagement of the engagement mechanism and removal of the cover portion from the base portion to open the container.

United States Patent Application Publication 2006/0289549 (Vovan) discloses a food container formed from plastic and can be loaded with food and then closed by a clerk, and thereafter cannot be opened without tearing apart first sides of the base and lid. The container is formed by a single sheet of plastic that forms a base and lid with second sides that are latched together and with adjacent first sides that are joined by a joint line in the plastic that is creased and that has slits. At the joint line, the lid has a projecting lid tab and the base has a projecting base tab. A person grasps both tabs, and lifts only the lid tab to tear apart the first sides of the base and lid along the joint line. Thereafter, the lid can be easily closed and reopened on the base.

SUMMARY

The following summary is provided to introduce the reader to the more detailed discussion to follow. The summary is not intended to limit or define the claims.

According to one broad aspect, a tamper evident container includes: a base having a base peripheral portion defining a base peripheral edge; and a lid having a lid peripheral portion defining a lid peripheral edge, the lid mountable to the base for bringing the container to a closed position, the closed position defined by engagement of the lid peripheral portion with the base peripheral portion about a periphery of the container and the lid overlying the base. The container further includes a base hinge panel joined to the base peripheral portion and extending outwardly therefrom; a lid hinge panel joined to the lid peripheral portion and extending outwardly therefrom, the base and lid hinge panels pivotally joined together at a pivot region, and the base and lid hinge panels having respective inner surfaces facing each other when the container is in the closed position, at least a portion of the inner surfaces spaced apart to form a gap therebetween when the container is in the closed position; and a frangible line of weakness extending at least partially across one of the base hinge panel and the lid hinge panel, the one of the base hinge panel and the lid hinge panel being separable along the frangible line of weakness into a grasping portion connected to one of the base and the lid, and a flap portion connected to the pivot region. When the container is in the closed position, at least a portion of the frangible line of weakness overlies the gap and is spaced inwardly from the pivot region towards one of the base peripheral portion and the lid peripheral portion, thereby reducing the risk of accidental separation of the base and lid along said frangible line of weakness.

In some examples, the frangible line of weakness extends at least partially across the lid hinge panel and the grasping portion is connected to the lid. The pivot region may include at least two pivot surfaces joined together at one or more generally non-frangible pivot edges. The frangible line of weakness may include a plurality of curves.

In some examples, the pivot region may be biased to pivot the flap portion away from the grasping portion when the one of the lid hinge panel and the base hinge panel is separated along the frangible line of weakness. When the container is in the closed position, at least one of the base peripheral edge and lid peripheral edge may be generally inaccessible to a user to inhibit opening the container without severing the frangible line of weakness. In some examples, The lid peripheral edge is generally inaccessible to a user when the container is in the closed position.

In some examples, the base may have a bottom panel, at least one sidewall extending upwardly from a periphery of the bottom panel, and the base peripheral portion can extend from the at least one sidewall. The lid may include a covering portion and the lid peripheral portion may extend outwardly from the covering portion.

In some examples, the base peripheral portion may include at least one engagement surface extending from an upper portion of said at least one sidewall to define an inwardly open recess, and the lid peripheral portion comprises a projection receivable in the recess when the container is the closed position. The base peripheral portion may include a seating surface positioned above the recess, and the lid peripheral portion may include a flange seatable on the seating surface when the container is in the closed position.

In some examples, a width of the flap portion may be less than a width of the base hinge panel. An entirety of the frangible line of weakness may overlie the gap.

The pivot region may be configured to pivot the flap portion away from the grasping portion when the one of the lid hinge panel and the base hinge panel is separated along the frangible line of weakness into the grasping portion and the flap portion. The pivot region may be characterized by absence of another frangible line of weakness.

According to some aspects, a tamper evident container includes: (a) a base having a base peripheral portion; (b) a lid having a lid peripheral portion defining a lid peripheral edge, the lid mountable to the base for bringing the container to a closed position, the closed position defined by engagement of the lid peripheral portion with the base peripheral portion about a periphery of the container and the lid overlying the base; (c) a base hinge panel extending outwardly from the base peripheral portion; (d) a lid hinge panel extending outwardly from the lid peripheral portion; (e) a pivot region pivotally connecting the base hinge panel and the lid hinge panel; the base hinge panel extending between the base peripheral portion and the pivot region, and the lid hinge panel extending between the lid peripheral portion and the pivot region; and (f) a frangible line of weakness extending at least partially across the lid hinge panel, at least a portion of the frangible line of weakness being spaced from and positioned inwardly of the pivot region towards the lid peripheral portion thereby reducing the risk of accidental separation of the base and the lid along said frangible line of weakness. The lid hinge panel may be separable along the frangible line of weakness to open the container, the lid hinge panel separable into a first portion connected to the lid and a second portion connected to the pivot region.

The container may be characterized by absence of another frangible line of weakness. The first portion may include a grasping portion and the second portion may include a flap portion. The frangible line of weakness may comprise a plurality of curves. The base and lid hinge panels may have respective inner surfaces facing each other when the container is in the closed position with at least a portion of the inner surfaces being spaced apart to define a gap therebetween. A portion of the frangible line of weakness may overlie the gap. The lid hinge panel may be at least separable by displacement of at least a portion of the second portion downwardly into the gap.

In some examples, the pivot region may include at least two pivot surfaces joined together at one or more non-frangible pivot edges. The lid peripheral edge may be generally inaccessible to a user when the container is in the closed position. The pivot region may be configured to pivot the second portion away from the first portion when the lid hinge panel is separated along the frangible line of weakness.

According to some aspects, a tamper evident container includes: (a) a base having an open upper end circumscribed by a base peripheral portion; (b) a lid having a cover portion circumscribed by a lid peripheral portion, the lid mountable to the base for bringing the container to a closed position, the closed position defined by engagement of the lid peripheral portion with the base peripheral portion about a periphery of the container and the base being supported on a generally horizontal surface with the open upper end of the base covered by the cover portion of the lid; (c) a base hinge panel joined to the base peripheral portion and extending outwardly therefrom; (d) a lid hinge panel joined to the lid peripheral portion and extending outwardly therefrom, the base and lid hinge panels pivotally joined together at a pivot region; (e) the lid hinge panel being situated above the base hinge panel when the container is in the closed position; (f) the base and lid hinge panels having respective inner surfaces facing each other when the container is in the closed position, with at least a portion of the inner surfaces being spaced apart to define a gap therebetween; and (g) a frangible line of weakness extending at least partially across the lid hinge panel, at least a portion of the frangible line of weakness lying above the gap when the container is in the closed position, the lid hinge panel being separable along the frangible line of weakness into a first portion connected to the lid, and a second portion connected to the pivot region, the first portion extending laterally outwardly beyond the lid peripheral portion, and the second portion extending between the frangible line of weakness and the pivot region; wherein the lid hinge panel is separable along the frangible line of weakness to open the container by grasping and separating the first portion from the second portion.

In some examples, the lid hinge panel may be separable by displacement of at least a portion of the second portion downwardly into the gap. The pivot region may include at least two pivot surfaces joined together at one or more non-frangible pivot edges. The lid peripheral portion may define a lid peripheral edge and the lid peripheral edge may be generally inaccessible to a user when the container is in the closed position. The pivot region may be configured to pivot the second portion away from the first portion when the lid hinge panel is separated along the frangible line of weakness.

According to some aspects, a tamper evident plastic food container includes: (a) a base defining a food receptacle and having a base peripheral portion defining a base peripheral edge; (b) a lid defining a cover and having a lid peripheral portion defining a lid peripheral edge, the lid peripheral portion securable to the base peripheral portion to mount the lid to the base and bring the container to a closed position; (c) a base hinge panel joined to the base peripheral portion and extending outwardly therefrom; (d) a lid hinge panel joined to the lid peripheral portion and extending outwardly therefrom, the base and lid hinge panels pivotally joined together at a pivot region, and the base and lid hinge panels having respective inner surfaces facing each other when the container is in the closed position; (e) a frangible line of weakness extending at least partially across the lid hinge panel, the lid hinge panel being separable along the frangible line of weakness into a first portion connected to the lid, and a second portion connected to the pivot region, said frangible line of weakness comprising a plurality of curves. When the container is in the closed position and oriented with the lid over the base, at least a portion of the frangible line of weakness may be spaced laterally inwardly away from the pivot region towards the lid peripheral portion.

In some examples, the lid hinge panel may include at least one grasping tab that remains attached to the lid after the frangible line of weakness has been severed. The pivot region may include a plurality of generally non-frangible pivot edges about which the lid hinge panel can pivot relative to the base hinge panel. The pivot region may be configured to pivot the second portion of the lid hinge panel away from the first portion when the lid hinge panel is separated along the frangible line of weakness. The first portion may be configured as a grasping portion and a second portion may be configured as a flap portion.

The pivot region may include a first pivot edge and at least a second pivot edge parallel to the first pivot edge and spaced apart from the first pivot edge, and plastic material of the container on either side of said first and second pivot edges may remain connected together across said first and second pivot edges after the frangible line of weakness has been severed.

The second pivot edge may be generally aligned vertically above the first pivot edge when the container is in the closed position and the lid overlies the base. When the lid is pivoted away from the base and the lid and base peripheral portions are oriented generally horizontally and in side-by-side relation, the first and second pivot edges may be spaced apart laterally, the second pivot edge disposed laterally intermediate the lid and the first pivot edge. When the lid is pivoted away from the base and the lid and base peripheral portions are oriented generally horizontally and in side-by-side relation, the frangible line of weakness may be spaced apart laterally from the first and second pivot edges, and the frangible line of weakness may be disposed between the lid and the second pivot edge. The frangible line of weakness may be disposed laterally between the lid and the second pivot edge.

In some examples, the pivot region may be characterized by absence of another frangible line of weakness. In some examples, the container may be characterized by absence of another frangible line of weakness. The base peripheral portion and the lid peripheral portion may remain intact after severing the frangible line of weakness such that the container is re-closeable after having been opened.

Other aspects and features of the present specification will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. In the drawings.

DESCRIPTION

Figure 1A:
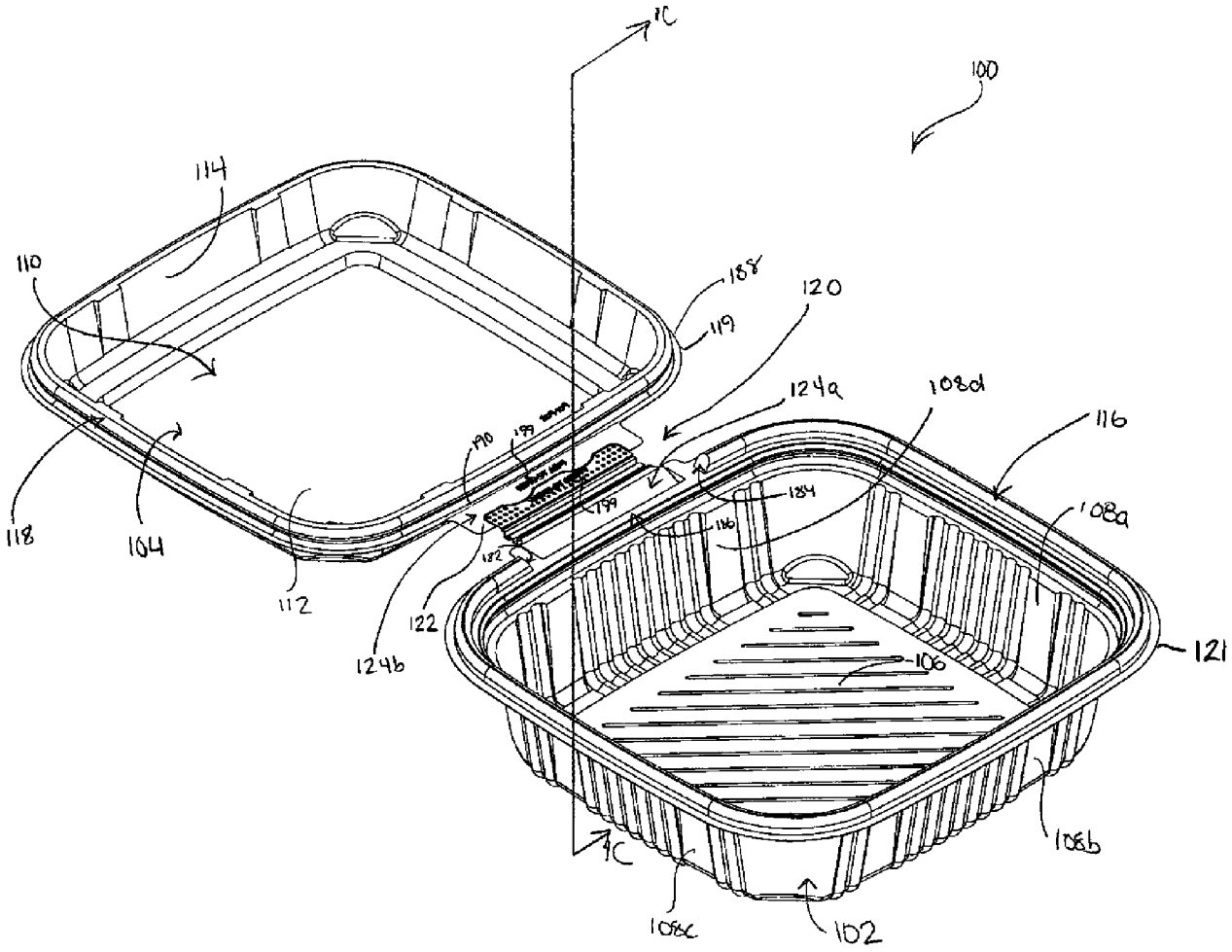
FIG. 1A is a perspective illustration of an example of a container, wherein the container is in an open configuration.

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Referring to FIGS. 1A-4B, an example of a container 100 is shown. The container 100 has an initial configuration, shown in FIGS. 1A to 1C, in which it is generally open and may be filled. The container 100 may be provided to a food preparation site in the initial configuration, such that it may be filled with food. The container 100 further has a second configuration, shown in FIGS. 2A and 2B, in which it is closed and locked. For example, after the container is filled at the food preparation site, it may be closed and locked, and provided to a distributor and/or seller in this configuration. The container 100 further has a third configuration, shown in FIGS. 4A and 4B, in which it is closed and unlocked. For example, after an end user such as a consumer purchases the container 100, they may unlock it, such that the container 100 may be then opened and the contents of the container 100 may be accessed. FIGS. 3A and 3B show the container in the process of being unlocked. As will be described further hereinbelow, the container 100 is generally configured such that after it has been unlocked for the first time, it provides visual evidence that it has been previously unlocked. Accordingly, the container 100 may be substantially tamper-resistant, tamper-evident, and/or tamper-proof. Further the container 100 is generally re-closeable, but not re-lockable, such that a user may re-close the container 100 as desired after it has been opened for the first time.

In the example shown, the container 100 comprises a base 102 and a lid 104. The base 102 generally defines a receptacle, which may receive various items to be stored in the container 100. The lid 104 generally serves to cover the base 102. Further, the base has a base peripheral portion 116, and the lid has a lid peripheral portion 118. The lid peripheral portion 118 is mountable to the base peripheral portion 116 to mount the lid 104 to the base 102.

In the example shown, the base 102 comprises a bottom panel 106, and a plurality of sidewalls 108 extending upwardly from a periphery of the bottom panel 106. In the example shown, the base 102 is generally square, and comprises four sidewalls 108*a*-108*d* extending upwardly from the bottom panel 106. In alternate examples, the base may be another shape, and may comprise another number of sidewalls. For example the bottom panel 106 may be generally circular, and a single rounded sidewall may extend upwardly therefrom. In alternate examples, the bottom panel and sidewalls may be substantially integral with each other, with out a clear delineation therebetween. For example, the base 102 may be generally hemi-spherical. The peripheral portion 116 of the base, to which the peripheral portion of the lid 118 is mounted, extends from the upper portion of the sidewalls 108. The peripheral portion 116 of the base 102 defines a peripheral edge 121 of the base.

Further, in the example shown, the lid 104 comprises a covering portion 110, which generally serves to cover the receptacle 102. The covering portion 110 includes an upper panel 112, and a skirt 114 extending downwardly from the upper panel 112. In alternate examples, the lid 104 may comprise only the upper panel, and a skirt may not be provided. The peripheral portion 118 of the lid 104, which mounts to the peripheral portion 116 of the base, extends outwardly from the skirt 114. The peripheral portion 118 of the lid 104 defines a peripheral edge 119 of the lid.

Figure 2A:
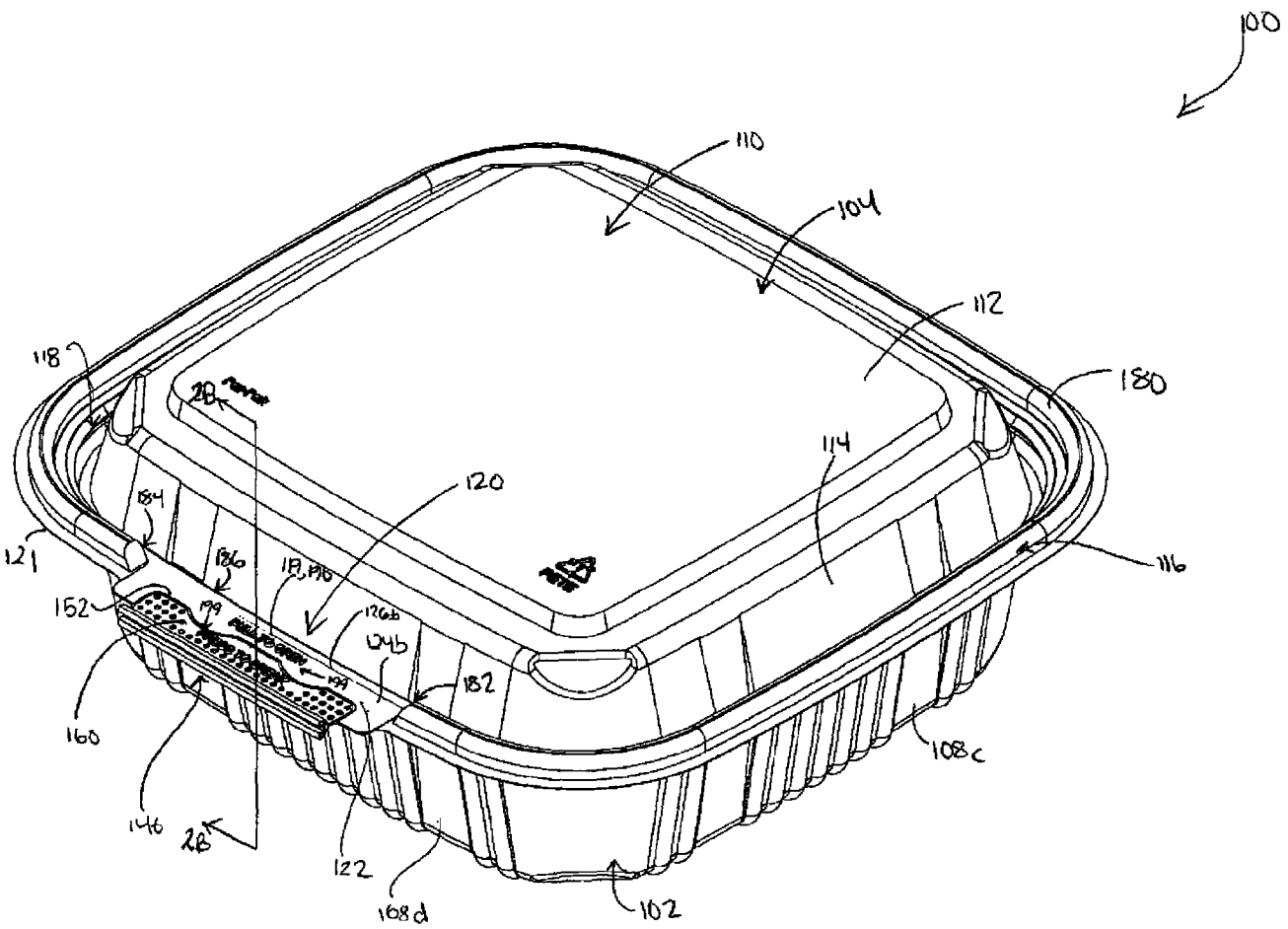
FIG. 2A is a perspective illustration of the container of FIG. 1A, wherein the container is in a closed and locked configuration.
Figure 2B:
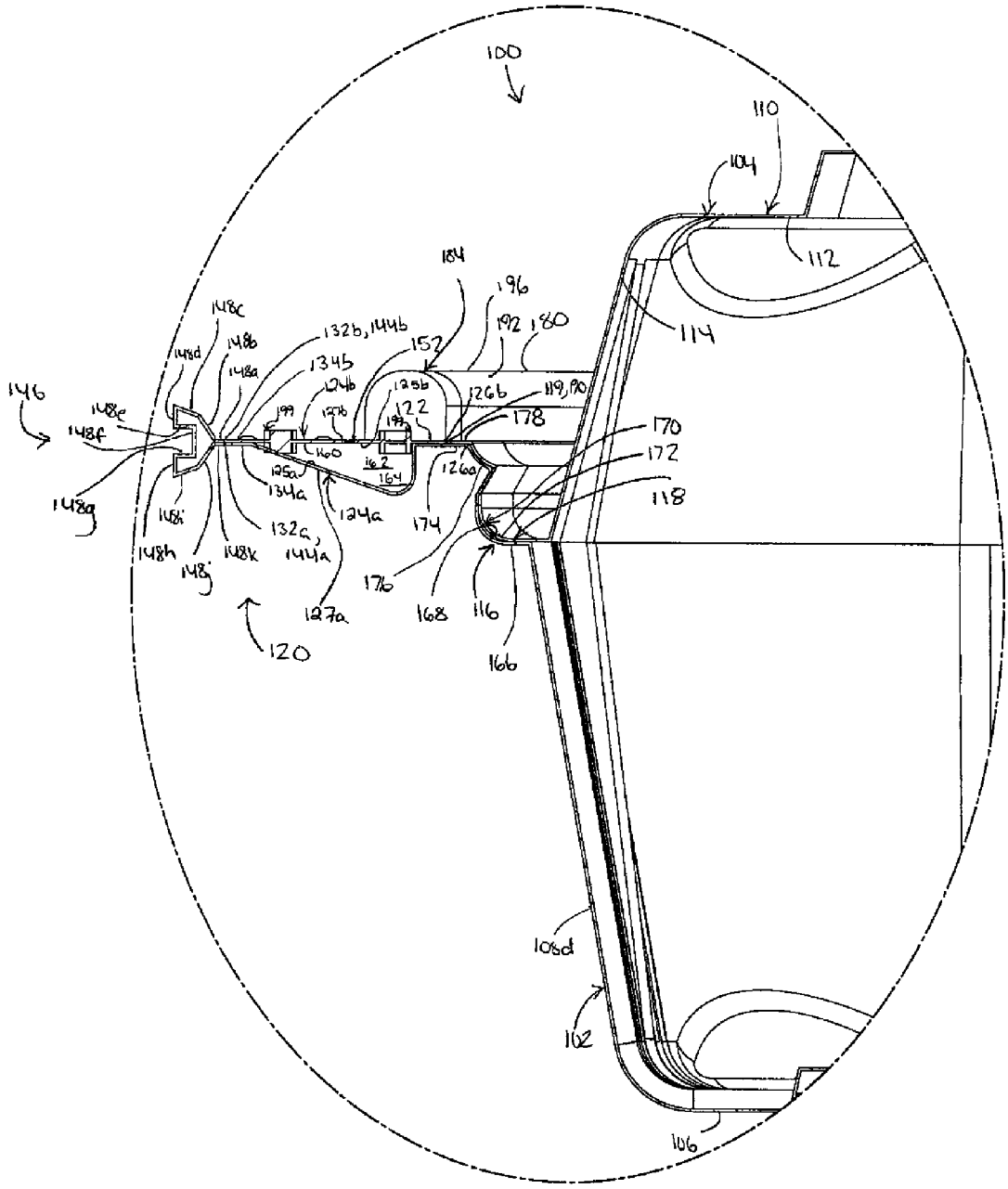
FIG. 2B is a cross-section taken along line 2B-2B in FIG. 2A.

The container 100 is generally configured such that after it has been unlocked for the first time, it provides visual evidence that it has been previously unlocked. Accordingly, if an unauthorized user unlocks and opens the container, for example to tamper with the contents, and then closes the container, the container may not be relocked (i.e. cannot be returned to its original pre-opened state), and will provide visual evidence to the next user that the container has been previously unlocked. In the example shown, a hinge member 120 is provided, which pivotably joins the base 102 to the lid 104. The container 100 is generally configured such that after the lid 104 is mounted to the base 102 for the first time as shown in FIGS. 2A and 2B (i.e. after the container has been filled and placed in the closed and locked configuration), the lid 104 can generally not be removed from the base 102 without separating the hinge member 120 into two portions, as shown in FIGS. 3A to 4B. That is, when the lid 104 is mounted to the base 104, the peripheral edge 119 of the lid 104 is concealed, as will be described further hereinbelow. Accordingly, a user may not grasp the peripheral edge 119 to remove the lid 104 from the base 102. However, when the hinge member 120 is separated (i.e. when the container is unlocked), a grasping portion 122 of the hinge member 120 becomes accessible to a user, and the user may grasp the grasping portion 120 to remove the lid 104 from the base 102. The separation of the hinge member 120 generates the visual evidence that the lid 104 has been removed.

It will be appreciated that in alternate examples, the container may be configured such that when the lid 104 is mounted to the base 104, the peripheral edge 121 of the base 102 is concealed, such that a user may not grasp the peripheral edge 121 to remove the lid 104 from the base 102.

Referring to FIGS. 1A-4B, in the example shown, the hinge member 120 comprises a base hinge panel 124*a* joined to the base peripheral portion 116, and a lid hinge panel 124*b* joined to the lid peripheral portion 118. The hinge panels 124*a*, 124*b* are pivotally joined together, to allow the lid 104 to pivot with respect to the base 102.

The panels 124*a*, 124*b* may be of a variety of shapes. In the example shown, each panel 124*a*, 124*b* has an inner surface 125*a*, 125*b*, and an outer surface, 127*a*, 127*b*. Further, each panel 124*a*, 124*b* is generally rectangular, and has, respectively, an inner edge 126*a*, 126*b*, first 128*a*, 128*b*, and second 130*a*, 130*b* opposed side edges, and an outer edge, 132*a*, 132*b* (shown in FIG. 1C). In the example shown, the lid hinge panel 124*b* is joined to the lid peripheral portion 118 along its inner edge 126*b*. Accordingly, the lid hinge panel 124*b* extends outwardly of the lid peripheral portion 118. Further, in the example shown, the base hinge panel 124*a* is joined to the base peripheral portion 116 along its inner edge 126*a*, and along a portion of the first 128*a* and second 130*a* side edges. Accordingly, the base hinge panel 124*a* extends partially outwardly of the base peripheral portion 116. When the container 100 is in the closed and locked configuration (i.e. after it has been filled and closed for the first time), the base hinge panel 124*a* and the lid hinge panel 124*b* are generally in vertical registration. That is, when the container 100 is in the closed and locked configuration, the lid hinge panel 124*b* seats above the base hinge panel 124*a*, and the inner surfaces 125*a*, 125*b* generally face each other and bear against each other.

In the example shown, each panel 124*a*, 124*b*, comprises a tab portion 134*a*, 134*b* extending outwardly therefrom. That is, the outer edge 132*a*, 132*b* of each panel defines a plurality of edges: a first 136*a*, 136*b* lateral edge extending inwardly from the first 128*a*, 128*b* side edge, a second 138*a*, 138*b* lateral edge extending inwardly from second 130*a*, 130*b* side edge, a first 140*a*, 140*b* protruding edge extending outwardly from the first 136*a*, 136*b* lateral edge, a second protruding edge 142*a*, 142*b* extending outwardly from the second 138*a*, 138*b* lateral edge, and a central edge 144*a*, 144*b* extending between the first 140, 14*b*, and second 142*a*, 142*b* protruding edges, respectively (shown in FIG. 1C).

In alternate examples, the panels 124*a*, 124*b* may be otherwise shaped, and may not extend outwardly or partially outwardly of the base peripheral portion 116 and lid peripheral portion 188, respectively. For example, one or both of the panels 124*a*, 124*b* may be joined to the base peripheral portion 116 and lid peripheral portion 118, respectively, along the inner edges 126*a*, 126*b*, and along the entirety of the side edges 128*a*, 128*b*, 130*a*, 130*b*. In such an example, one or both of the panels 124*a*, 124*b* may seat inwardly of the base peripheral portion 116 and lid peripheral portion 118, respectively.

As previously mentioned, the hinge panels 124*a*, 124*b* are pivotally joined together, to allow the lid 104 to pivot with respect to the base 102. In the example shown, the lid hinge panel 124*a* and the base hinge panel 124*b* are joined together at a pivot region 146. In the example shown, the pivot region 146 comprises a plurality of surfaces 148*a*-148*k* (shown in FIGS. 1C and 2B-4B), provided between the outer edge 132*a* of the base hinge panel 124*a* and the outer edge 132*b* of the lid hinge panel 124*b*. The surfaces are joined together along a plurality of pivot edges 150*a*-150*j* (shown in FIG. 1C), which are generally weakened, although generally not frangible, such that the pivot region 146 may be bent along these edges 150*a*-150*j* to pivot the lid 104 away from the base 102 when the container 100 is unlocked.

In the example shown, the pivot region 146 extends only partially along the outer edges 132*a*, 132*b* of the panels 124*a*, 124*b*. That is, the pivot region extends along the central edge 144*a*, 144*b* of each panel 124*a*, 124*b*. However, in alternate examples, for example wherein tab portions 134*a*, 134*b* are not provided, and the outer edges 132*a*, 132*b* comprise a single edge extending between the first 128*a*, 128*b*, and second 130*a*, 130*b* side edges, respectively, the pivot region 146 may extend along the entirety of the outer edges 132*a*, 132*b*.

Referring to FIGS. 1A-4B, one of the base hinge panel 124*a* and the lid hinge panel 124*b* has a line of weakness 152 extending at least partially thereacross. In the example shown, the lid hinge panel 124*b* has the line of weakness 152. Further, in the example shown, the line of weakness 152 extends only partially across the lid hinge panel 124*b*. That is, the line of weakness 152 has a first portion 154 extending inwardly from the junction of the first lateral edge 136*b* and the first protruding edge 140*b*, a second portion 156 extending laterally across the panel 124*b*, and a third portion 158 extending outwardly towards the junction of the second lateral edge 138*b* and the second protruding edge 142*b*.

In alternate examples, the line of weakness may extend in another manner. For example, the line of weakness 152 may comprise only a single portion extending entirely across the panel 124*b*, from the first side edge 128*b* to the second side edge 130*b*. Further, in alternate examples, the base hinge panel 124*a* may comprise the line of weakness.

Referring to FIGS. 1A-4B, at least a portion of the line of weakness 152 is spaced from and positioned inwardly of the pivot region 146. As used herein 'inwardly' refers to a direction towards a central portion of the container. In the example shown, each of the first 154, second 156, and third 158 portions of the line of weakness 152 are spaced from and positioned inwardly of the pivot region 146. That is, the first 140*b* and second 142*b* protruding edges are positioned between second 156 and third 158 portions of the line of weakness 152 and the pivot region 146, respectively. In alternate examples, only one or only some portions of the line of weakness 152 may be spaced from and positioned inwardly of the pivot region 146. By providing at least a portion of the line of weakness 152 spaced from and inwardly of the pivot region 146, the risk of accidental separation of the lid hinge panel 124*b* along the line of weakness, for example during shipping, may be prevented, minimized, or reduced.

The amount that each portion of the line of weakness 152 is spaced from the pivot region 146 may vary. In the example shown, the first 154 and third 158 portions of the line of weakness are spaced from the pivot region by about 0.5 cm, and the second 156 portion of the line of weakness 152 is spaced from the pivot region by about 1 cm. In alternate examples, any of the portions may be spaced from the line of weakness by another amount, for example between about 0.1 cm and 2 cm.

Referring to FIGS. 3A-4B, the lid hinge panel 124*b* is separable along the line of weakness 152. That is, the line of weakness 152 generally defines a frangible portion of the lid hinge panel 124*b*, which may be broken or torn. The lid hinge panel 124*b* is separable along the line of weakness 152 into a grasping portion 122 connected to the lid 104, and a flap portion 160 connected to the pivot region 146. When the lid hinge panel 124*b* has been separated along the line of weakness 152, the user may grasp the grasping portion 122 to remove the lid 104 from the base 102. That is, in order to unlock the container 100, the user may separate the lid hinge panel 124*b* along the line of weakness 152. The separation of the lid hinge panel 124*b* provides visual evidence that the container 100 has been previously opened.

Figure 3A:
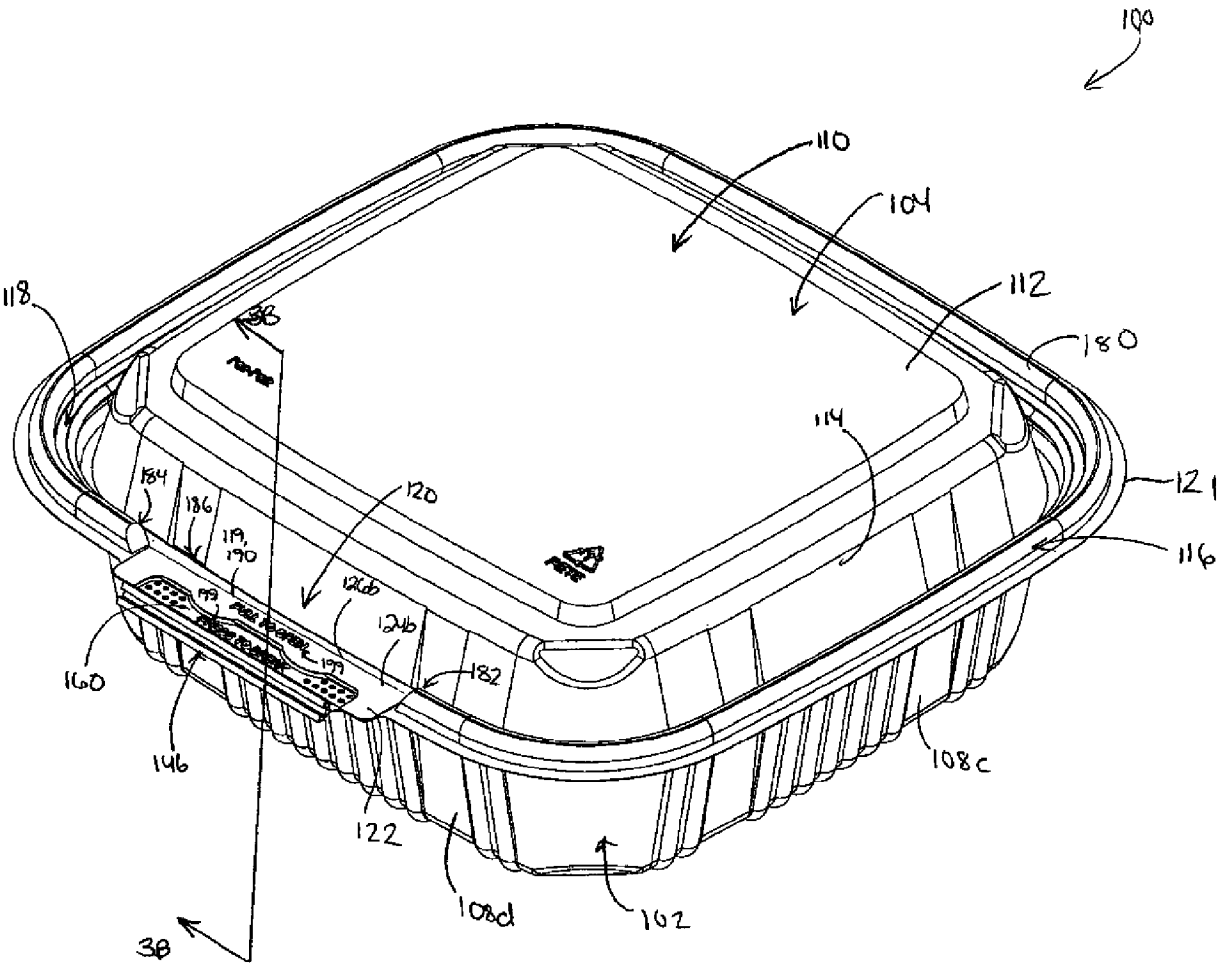
FIG. 3A is a perspective illustration of the container of FIG. 1A, wherein the container is in the process of being unlocked.
Figure 3B:
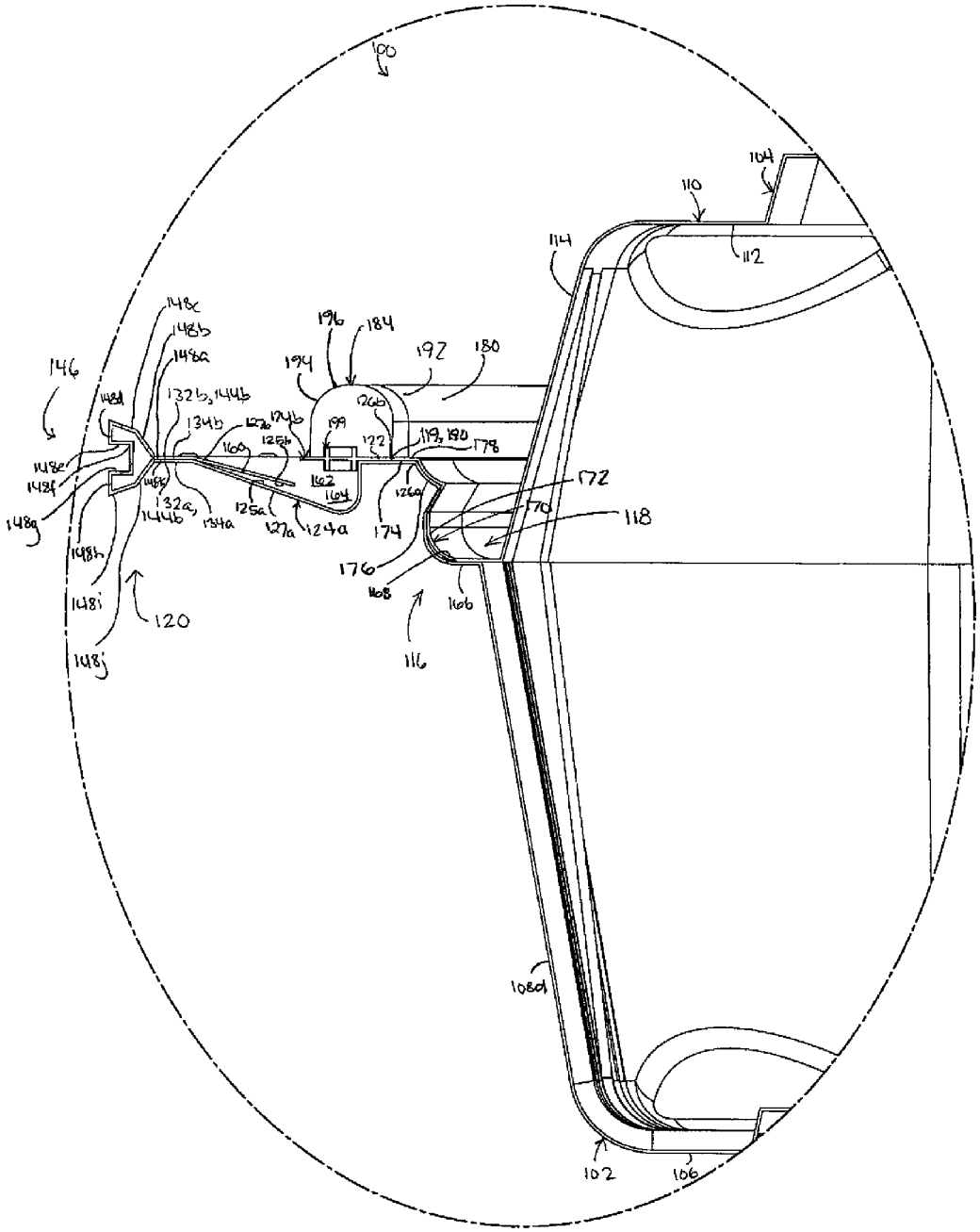
FIG. 3B is a cross-section taken along line 3B-3B in FIG. 3A.

The user may separate the lid hinge panel 124*b* in a variety of ways. In some examples, when the container is in the closed and locked configuration, at least a portion of the inner surface 125*a* of the base hinge panel 124*a* and at least a portion of the inner surface 125*b* of the lid hinge panel 124*b* are spaced apart to form a gap 162 therebetween, and at least a portion of the line of weakness 152 overlies the gap 162. For example, as shown, the base hinge panel 124*a* may comprise a downwardly extending recess 164, which defines the gap 162. Further, in the example shown, the second portion 156 of the line of weakness 152 overlies the gap. In order to separate the lid hinge panel 124*b*, a user may displace at least a portion of either the flap portion 160 or the grasping portion 122 downwardly into the gap, as shown in FIGS. 3A-3B. For example, a user may apply pressure to the flap portion 160 to displace at least a portion of the flap portion into the gap 162. As the flap portion 160 displaces, the lid hinge panel 124*b* may break or sever at the line of weakness 152. While the flap 160 is still displaced downwardly, the user may grasp the grasping portion to lift the lid 104 off of the base 102. Alternately, the user may release the flap portion, and allow it to automatically pivot away from the grasping portion, as will be described further hereinbelow, and then grasp the grasping portion 122 to lift the lid 104 off of the base 102.

In alternate examples, the lid hinge panel 124*b* may be separated in other ways. For example a pull-tab may be provided on the flap 160, which the user may grasp in order to pull the flap 160 upwardly and sever the lid hinge panel 124*b* at the line of weakness.

In the example shown, the second portion 156 of the line of weakness 152 defines a plurality of curves. When the lid hinge panel 124*b* is separated into the grasping portion 122 and the flap portion 160, the plurality of curves provide a plurality of grasping protrusions 167 along the grasping portion 122 (shown in FIG. 4A). The grasping protrusions 167 may aid a user in grasping the grasping portion 122.

In alternate examples, the line of weakness may not comprise any curves. For example, the second portion 156 may extend in a substantially straight manner.

Figure 4A:
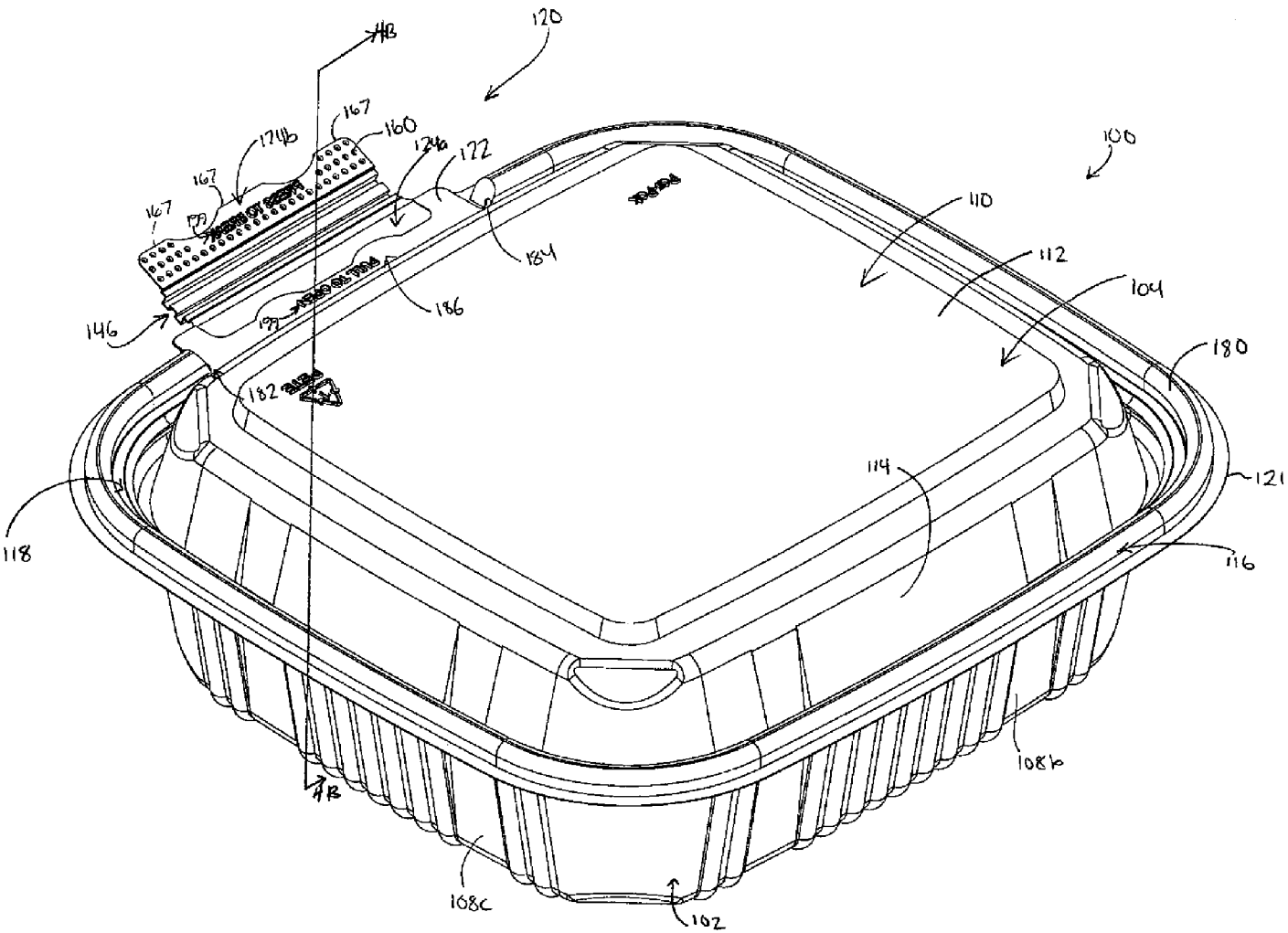
FIG. 4A is a perspective illustration of the container of FIG. 1A, wherein the container is closed and unlocked.
Figure 4B:
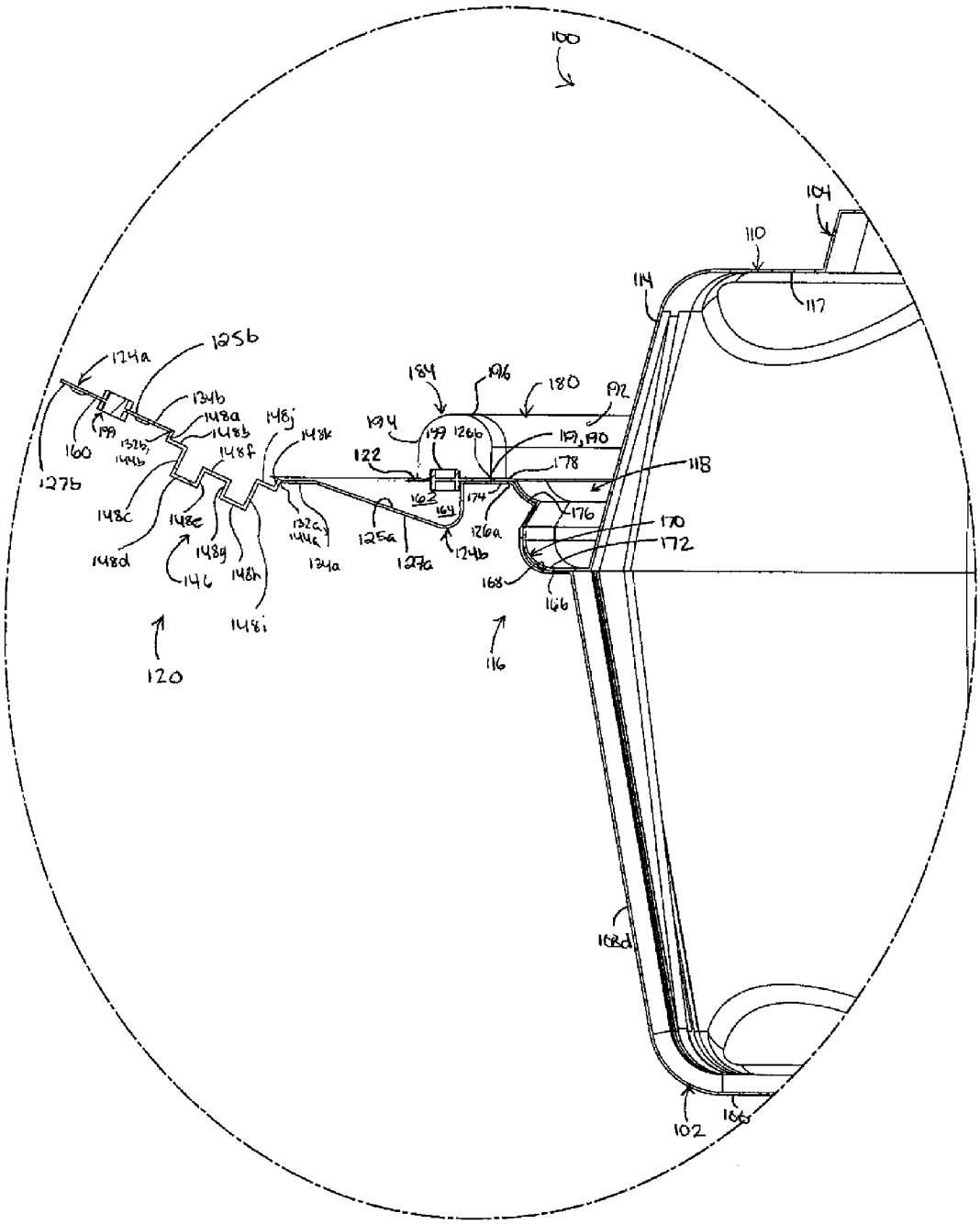
FIG. 4B is a cross-section taken along line 4B-4B in FIG. 4A.

As mentioned hereinabove, the separation of the lid hinge panel 124*b* provides visual evidence that the container 100 has been previously opened. Furthermore, in the example shown, the hinge member 120 is configured such that the pivot portion 146 is biased to pivot the flap portion 160 away from the grasping portion 122 when the lid hinge panel 124*b* has been separated into the grasping portion 122 and the flap portion 160. That is, referring to FIG. 1C, the pivot surfaces 148*a*-148*k* are configured such that in the absence of external forces, for example when the container is in the open configuration, the pivot surfaces 148*a*-148*k* extend from each other at approximate right angles. However, when the lid is mounted to the receptacle and the container is in the closed and locked configuration, the pivot surfaces 148*a*-148*k* are compressed towards each other, as shown in FIGS. 2A to 3B, and extend from each other at acute angles. Referring to FIGS. 4A and 4B, when the lid hinge panel 124*b* is separated along the line of weakness and the user releases the flap portion 160, the pivot surfaces 148*a*-148*k*, flex back to their original configuration, wherein they extend from each other at approximate right angles. This causes the flap portion 160 to pivot away from grasping portion 122. The flap portion 160 therefore protrudes from the container 100, and his provides an additional visual indication to the user that the container has previously been unlocked.

As mentioned hereinabove, in the example shown, when the lid 104 is mounted to the base 104, the peripheral edge 119 of the lid 104 is concealed. Accordingly, a user may not grasp the peripheral edge 119 to remove the lid 104 from the base 102, and generally must separate the lid hinge panel 124*b* in order to grasp the grasping portion 122 and lift the lid off of the receptacle. The peripheral edge 19 of the lid may be concealed in a variety of ways, and the lid may be mounted to the receptacle in a variety of ways.

In the example shown, the peripheral portion 116 of the base 102 comprises at least one engagement surface 166 defining an inwardly open recess 168. Further, in the example shown, the lid peripheral portion 118 comprises a projection 170. The projection 170 is snapably receivable in recess 168, such that the lid 104 may be securely mounted to the receptacle 102. For example, if container 100 is inverted, projection 170 and recess 168 may prevent lid 104 from falling off of receptacle 102.

In the example shown, the inwardly open recess is defined by a first engagement surface 166*a* extending outwardly from the upper portion of the sidewalls 108, a second engagement surface 166*b* extending upwardly from the first surface 166*a*, and a third engagement 166*c* surface extending inwardly and upwardly from the second surface 166*b*. Accordingly, the recess 168 is inwardly and upwardly open. In alternate examples, the recess 168 may otherwise configured. For example, the at least one engagement surface 166 may comprise a single rounded surface extending sequentially outwardly, upwardly, and inwardly from the upper portion of the at least one sidewall 108. Furthermore, the recess may be only inwardly open.

In the example shown, recess 168 extends around the entire periphery of the base 102, and extends outwardly from the skirt 114. However, in alternate examples, recess 168 may extend around only a portion of the periphery of the base 102. Furthermore, a plurality of recess portions may be provided, which may be located at various positions around the periphery of the base 102.

In the example shown, the projection 170 is defined by a first outwardly extending surface 172*a*, a second upwardly extending surface 172*b*, and a third inwardly and upwardly extending surface 172*c*. In alternate examples, projection 170 may be otherwise shaped, in order to mate with recess 168. For example, if recess 168 is rounded, projection 170 may also be rounded. Furthermore, if recess 168 extends around only a portion of the periphery of the base 102, projection 170 may extend around a corresponding portion of the lid 104.

In the example shown, the base peripheral portion 118 further comprises a seating surface 174 positioned above the recess 168. Further, in the example shown, the lid 104 comprises a flange 178 positioned outwardly of projection 170. Flange 178 has an outer edge, which defines the peripheral edge 119 of lid 102. Flange 178 is generally configured to seat on the seating surface 174 when the projection 170 is received in the recess 168, or when the lid 14 is otherwise secured to the receptacle 12.

In the example shown, the seating surface 174 is positioned indirectly above the recess 168. That is, in the example shown, an intermediate surface 176 is positioned between recess 168 and seating surface 174. In alternate examples, seating surface 174 may be positioned directly above recess 168 and extend directly from surface 166.

In the example shown, seating surface 174 is positioned outwardly of recess 168. However, in some examples, seating surface 174 and recess 168 may at least partially overlap. Further, in some examples, flange 74 and projection 70 may at least partially overlap.

Seating surface 174 may be of a variety of configurations. In the example shown, seating surface 174 comprises a generally planar surface defining a flange extending about the peripheral portion 116 of the base. In other examples, seating surface 174 may extend around only a portion of the receptacle or a plurality of seating surface portions may be provided, which may extend from various positions around the peripheral portion 116 of the base 102.

Flange 178 may be of a variety of configurations. In the example shown, the flange 178 comprises a generally flat outwardly extending surface which extends about the entire peripheral portion 116 of the lid 104. In other examples, flange 178 may be otherwise configured. For example, flange 178 may extend about only a portion of the peripheral portion of the lid 104, or a plurality of flange portions may be provided.

In order to prevent a user from accessing the peripheral edge 119 of the lid 104 when the lid is mounted to the receptacle, a barrier wall 180 is provided on the peripheral portion 116 of the base 102, which extends upwardly from an outer portion of the seating surface 174. The barrier wall 180 extends about a portion of the peripheral portion 116 of the base 102, from a first position 182 to a second position 184. The first position 182 and the second position 184 are spaced perimetrically apart, such that a gap region 186 is positioned therebetween. The base hinge panel 124*a* is provided between the first position 182 and the second position 184, and extends outwardly from the seating surface 174.

When the lid is mounted to the base, a first portion 188 of the peripheral edge 119 of the lid 102 is in perimetrical registration with the barrier wall 180. Accordingly, the user may generally not access or grasp the first portion 188 to remove the lid 104 from the base 102. A second portion 190 of the peripheral edge 119, (i.e. the remainder of the peripheral edge 119) is at the gap region 186, and extends between the first position 182 and the second position 184. The lid hinge panel 124*b* extends outwardly from the second portion, and is provided between the first position 182 and the second position 184. Accordingly, the user may generally not access or grasp the second portion 190 to remove the lid 104 from the base 102.

In the example illustrated, the barrier wall 180 extends generally perpendicularly from the outer portion of the seating surface 174. Accordingly, when the base 102 is viewed from above, along an axis extending perpendicularly to the seating surface 174, the outer portion of the seating surface 174 is visible. In other examples, the barrier wall 180 may be at an angle θ of less than 90° with respect to the outer portion of the seating surface 174.

In the example shown, the barrier wall 180 is three-dimensional, having an inner wall portion 192, an outer wall portion 194, and a top wall portion 198 extending therebetween. In alternate examples, the barrier wall may comprise, for example, only inner wall portion 192. In the example shown, base peripheral portion 116 further comprises a lip 198 extending outwardly from the barrier wall 180. The lip extends about the base peripheral portion 118 from the first position 182 to the second position 184, and is integrally joined with the base hinge panel 124*a*.

Figure 1B:
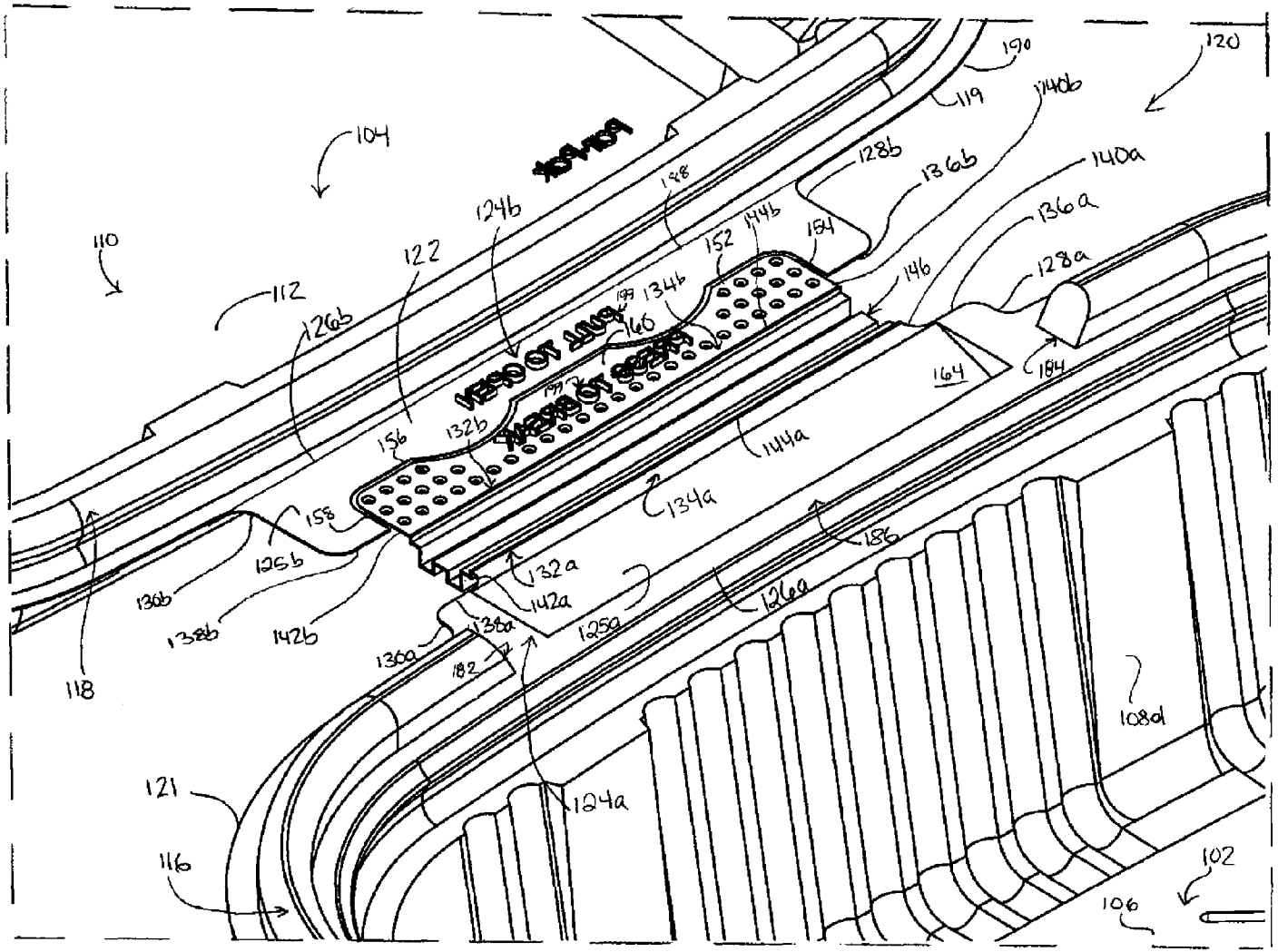
FIG. 1B is an enlarged perspective illustration of the hinge member shown in FIG. 1A.
Figure 1C:
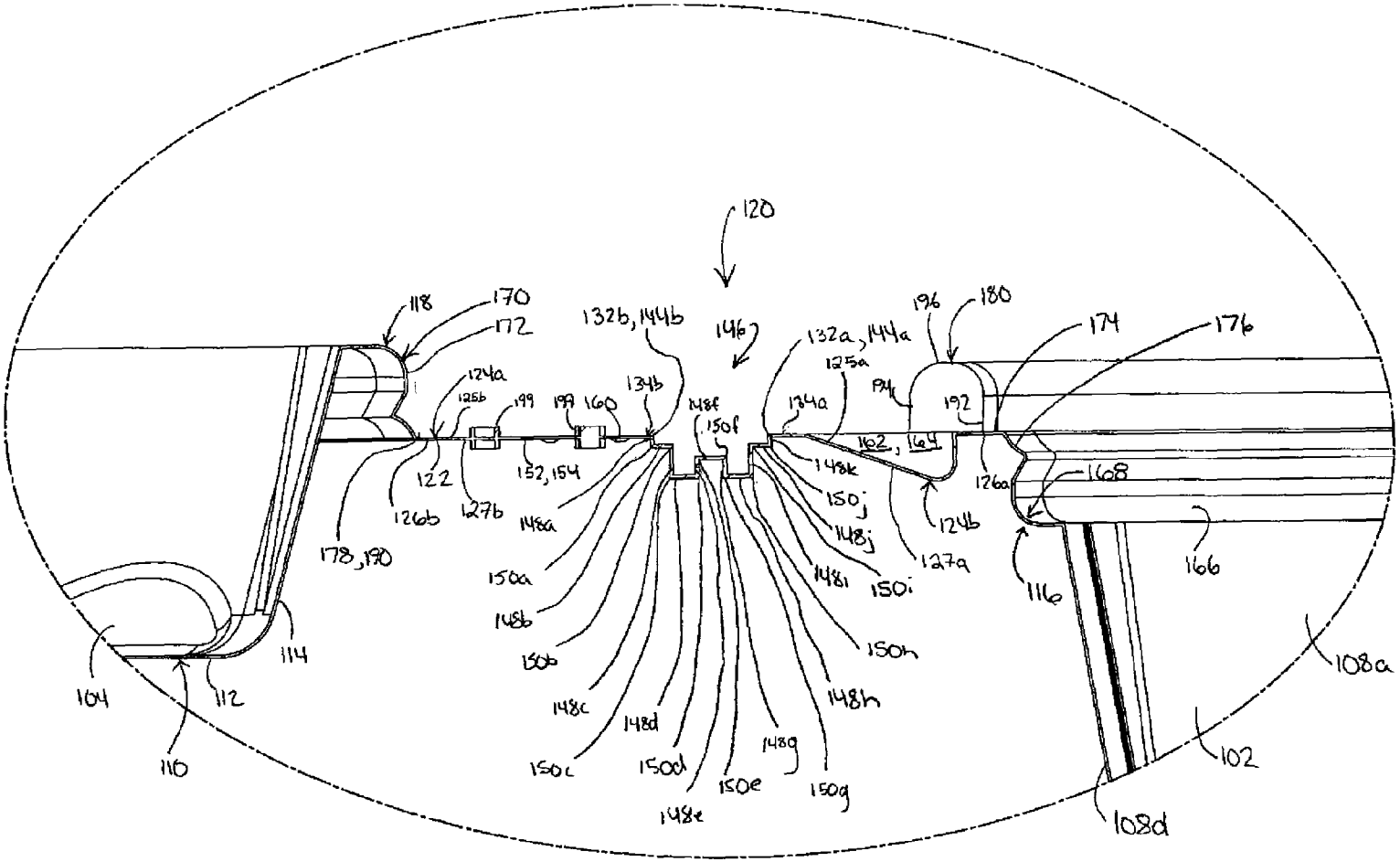
FIG. 1C is a cross-section taken along line 1C-1C in FIG. 1A.

In use, the container 100 may be provided in the open configuration, as shown in FIGS. 1A to 1C. That is, the lid 104 may be pivotally mounted to base 102 by hinge member 120. The container 100 may then be filled, for example with food. The container may then be closed and locked, as shown in FIGS. 2A and 2B. That is, lid 104 may be pivoted downwardly and force may be applied to mount the lid peripheral portion 118 to the base peripheral portion 116. For example, force may be applied to snap projection 170 into recess 168. In this closed and locked configuration, the peripheral edge 119 of the lid 104 is concealed. That is, a first portion 188 of the peripheral edge 119 is in perimetrical registration with the barrier wall, and therefore cannot be grasped, and a second portion 190 of the peripheral edge 119 is concealed by the lid hinge panel 124*b*, which extends integrally outwardly therefrom, and therefore cannot be grasped. The container 100 may be shipped, stored, and sold in the closed and locked configuration. When a user purchases the container, the container may be inspected to see if it has been previously opened, for example to see if it has been tampered with. That is, the user may inspect the hinge member 120 to see if the lid hinge panel 124*b* has been separated along the line of weakness 152. If the lid hinge panel 124*b* has not been separated along the line of weakness 152, the container 100 may be purchased. In order to unlock the container 100, the user may separate the lid hinge panel 124*b* along the line of weakness. For example, the user may apply pressure to the flap portion 160 to displace the flap portion 160 into gap 162 and sever the lid hinge panel 124*b* along the line of weakness, as shown in FIGS. 3A-3B. The user may then release the flap portion 160, and the flap portion 160 may automatically pivot away from the grasping portion 122, as shown in FIGS. 4A-4B. The user may then grasp the grasping portion 122 to lift the lid 104 off of the base 102. If the user wishes to re-close the container 100, the user may place lid 104 back onto the base 102, and apply pressure to snap the projection 170 into the recess 168.

In any of the above examples, the container 100 may comprise instructions provided on the container for aiding the user in operating the container. For example, as shown, the container 100 comprises lettering 199 embossed on the hinge member, instructing a user how to operate the container 100.

While the above description provides examples of one or more processes or apparatuses, it will be appreciated that other processes or apparatuses may be within the scope of the accompanying claims.

The invention claimed is:

1. A tamper evident container comprising:

a) a base having a base peripheral portion defining a base peripheral edge;

b) a lid having a lid peripheral portion defining a lid peripheral edge, the lid mountable to the base for bringing the container to a closed position, the closed position defined by engagement of the lid peripheral portion with the base peripheral portion about a periphery of the container and the lid overlying the base;

c) a base hinge panel joined to the base peripheral portion and extending outwardly therefrom;

d) a lid hinge panel joined to the lid peripheral portion and extending outwardly therefrom, the base and lid hinge panels pivotally joined together at a pivot region, and the base and lid hinge panels having respective inner surfaces facing each other when the container is in the closed position, at least a portion of the inner surfaces spaced apart to form a gap therebetween when the container is in the closed position; and e) a frangible line of weakness extending at least partially across one of the base hinge panel and the lid hinge panel, the one of the base hinge panel and the lid hinge panel being separable along the frangible line of weakness into a grasping portion connected to one of the base and the lid, and a flap portion connected to the pivot region;

f) wherein, when the container is in the closed position, at least a portion of the frangible line of weakness overlies the gap and is spaced inwardly from the pivot region towards one of the base peripheral portion and the lid peripheral portion, thereby reducing the risk of accidental separation of the base and lid along said frangible line of weakness, and wherein the frangible line of weakness is severable while the container is in the closed position by displacement of at least a portion of the one of the base hinge panel and the lid hinge panel into the gap, and wherein prior to severing the frangible line of weakness, at least one of the base peripheral edge and lid peripheral edge is generally inaccessible to a user about the periphery of the container when the container is in the closed position to inhibit opening the container without severing the frangible line of weakness.

2. The container of claim 1, wherein the frangible line of weakness extends at least partially across the lid hinge panel and the grasping portion is connected to the lid.

3. The container of claim 1, where the pivot region comprises at least two pivot surfaces joined together at one or more generally non-frangible pivot edges.

4. The container of claim 1, wherein the frangible line of weakness comprises a plurality of curves.

5. The container of claim 1, wherein the pivot region is biased to pivot the flap portion away from the grasping portion when the one of the lid hinge panel and the base hinge panel is separated along the frangible line of weakness.

6. The container of claim 1, wherein prior to severing the line of weakness, the lid peripheral edge is generally inaccessible to the user about the periphery of the container when the container is in the closed position.

7. The container of claim 1, wherein a width of the flap portion is less than a width of the base hinge panel.

8. The container of claim 1, wherein an entirety of the frangible line of weakness overlies the gap.

9. The container of claim 1, wherein the pivot region is configured to pivot the flap portion away from the grasping portion when the one of the lid hinge panel and the base hinge panel is separated along the frangible line of weakness into the grasping portion and the flap portion.

10. The container of claim 1, wherein the pivot region is characterized by absence of another frangible line of weakness.

11. The container of claim 1, wherein the frangible line of weakness is severable by displacement of at least a portion of the flap portion into the gap.

12. The container of claim 2, wherein the base hinge panel comprises a downwardly extending recess defining at least a portion of the gap.

13. The container of claim 2, wherein the base has an open end circumscribed by the base peripheral portion and the lid has a cover portion circumscribed by the lid peripheral portion, the closed position further defined by the base being supported on a generally horizontal surface with the open upper end of the base covered by the cover portion of the lid and the lid hinge panel being situated above the base hinge panel, and wherein when the container is in the closed position, the lid hinge panel is separable along the frangible line of weakness to open the container by grasping and separating the grasping portion from the flap portion.

14. The container of claim 1, wherein the closed position is defined by snap-fit engagement of the lid peripheral portion with the base peripheral portion, the snap-fit engagement preventing the lid from falling off the base when the frangible line of weakness is severed and the container is inverted in the closed position.

15. A tamper evident container comprising:

a) a base having a base peripheral portion circumscribing an open upper end of the base;

b) a lid having a lid peripheral portion defining a lid peripheral edge, the lid mountable to the base with the lid overlying the open upper end of the base for bringing the container to a closed position, the closed position defined by interlocking engagement of the lid peripheral portion with the base peripheral portion about an entire periphery of the container, the interlocking engagement being releasable and re-engageable for opening and re-closing the container;

c) a base hinge panel extending outwardly from the base peripheral portion;

d) a lid hinge panel extending outwardly from the lid peripheral portion;

e) a pivot region pivotally connecting the base hinge panel and the lid hinge panel; the base hinge panel extending between the base peripheral portion and the pivot region, and the lid hinge panel extending between the lid peripheral portion and the pivot region;

f) a frangible line of weakness extending at least partially across the lid hinge panel, at least a portion of the frangible line of weakness being spaced from and positioned inwardly of the pivot region towards the lid peripheral portion thereby reducing the risk of accidental separation of the base and the lid along said frangible line of weakness;

g) wherein when the container is in the closed position, the lid hinge panel is separable along the frangible line of weakness to open the container, the lid hinge panel separable into a first portion connected to the lid and a second portion connected to the pivot region; and wherein said container is characterized by absence of another frangible line of weakness.

16. The container of claim 15, wherein the first portion includes a grasping portion and the second portion includes a flap portion.

17. The container of claim 15, wherein the frangible line of weakness comprises a plurality of curves.

18. The container of claim 15, wherein the base and lid hinge panels have respective inner surfaces facing each other when the container is in the closed position with at least a portion of the inner surfaces being spaced apart to define a gap therebetween.

19. The container of claim 18, wherein a portion of the frangible line of weakness overlies the gap.

20. The container of claim 18, wherein said lid hinge panel is at least separable by displacement of at least a portion of the second portion downwardly into the gap.

21. The container of claim 15, wherein the pivot region comprises at least two pivot surfaces joined together at one or more non-frangible pivot edges.

22. The container of claim 15, wherein prior to severing the frangible line of weakness the lid peripheral edge is generally inaccessible to a user when the container is in the closed position to inhibit opening the container without severing the frangible line of weakness.

23. The container of claim 15, wherein the pivot region is configured to pivot the second portion away from the first portion when the lid hinge panel is separated along the frangible line of weakness.

24. A tamper evident plastic food container, comprising:

a) a base defining a food receptacle and having a base peripheral portion circumscribing an open upper end of the base;

b) a lid defining a cover and having a lid peripheral portion circumscribing the cover, the lid peripheral portion securable to the base peripheral portion to mount the lid to the base and bring the container to a closed position;

c) a base hinge panel joined to the base peripheral portion and extending outwardly therefrom;

d) a lid hinge panel joined to the lid peripheral portion and extending outwardly therefrom, the base and lid hinge panels pivotally joined together at a pivot region, and the base and lid hinge panels having respective inner surfaces facing each other when the container is in the closed position;

e) a frangible line of weakness extending at least partially across the lid hinge panel, the lid hinge panel being separable along the frangible line of weakness into a first portion connected to the lid, and a second portion connected to the pivot region, the frangible line of weakness severable while the container is in the closed position, wherein severing the line of weakness exposes a peripheral edge on at least one of the base hinge panel and the lid hinge panel to enable opening the container by grasping said one of the base hinge panel and the lid hinge panel adjacent the exposed peripheral edge; and f) wherein when the container is in the closed position and oriented with the lid over the base, at least a portion of the frangible line of weakness is spaced laterally inwardly away from the pivot region towards the lid peripheral portion.

25. The container of claim 24, wherein the lid hinge panel comprises at least one grasping tab adjacent the exposed peripheral edge that remains attached to the lid after the frangible line of weakness has been severed.

26. The container of claim 24, wherein the pivot region comprises a plurality of generally non-frangible pivot edges about which the lid hinge panel can pivot relative to the base hinge panel.

27. The container of claim 24, wherein the pivot region is configured to pivot the second portion of the lid hinge panel away from the first portion when the lid hinge panel is separated along the frangible line of weakness.

28. The container of claim 24, wherein the first portion is configured as a grasping portion and a second portion is configured as a flap portion.

29. The container of claim 24, wherein the pivot region comprises a first pivot edge and at least a second pivot edge parallel to the first pivot edge and spaced apart from the first pivot edge, wherein plastic material of the container on either side of said first and second pivot edges remains connected together across said first and second pivot edges.

30. The container of claim 29, wherein the second pivot edge is generally aligned vertically above the first pivot edge when the container is in the closed position and the lid overlies the base.

31. The container of claim 29, wherein when the line of weakness is intact and the lid is pivoted away from the base and the lid and base peripheral portions are oriented generally horizontally and in side-by-side relation, the first and second pivot edges are spaced apart laterally, the second pivot edge disposed laterally intermediate the lid and the first pivot edge.

32. The container of claim 29, wherein when the line of weakness is intact and the lid is pivoted away from the base and the lid and base peripheral portions are oriented generally horizontally and in side-by-side relation, the frangible line of weakness is spaced apart laterally from the first and second pivot edges, and the frangible line of weakness is disposed between the lid and the second pivot edge.

33. The container of claim 29, wherein the frangible line of weakness is disposed laterally between the lid and the second pivot edge.

34. The container of claim 24, wherein the pivot region is characterized by absence of another frangible line of weakness.

35. The container of claim 24, wherein the container is characterized by absence of another frangible line of weakness.

36. The container of claim 24, wherein the base peripheral portion and the lid peripheral portion remain intact after severing the frangible line of weakness such that the container is re-closeable after having been opened.

37. The container of claim 24, wherein the closed position is defined by interlocking engagement of the lid peripheral portion with the base peripheral portion about an entire periphery of the container, the interlocking engagement being releasable and re-engageable for opening and re-closing the container.

38. The container of claim 24, wherein one of the base peripheral portion and the lid peripheral portion comprises a laterally inwardly open recess and the other of the base peripheral portion and the lid peripheral portion comprises a laterally outwardly extending protrusion, the protrusion releasably receivable in the recess for providing a releasable snap-fit engagement between the lid and the base about an entire periphery of the container to move the container between open and closed conditions.

39. The container of claim 24, wherein the frangible line of weakness comprises a plurality of curves.

* * * * *